US011541415B2

(12) United States Patent
Jan

(10) Patent No.: US 11,541,415 B2
(45) **Date of Patent: *Jan. 3, 2023**

(54) GLUE APPLYING MECHANISM OF EDGE BANDING MACHINE FOR APPLYING GLUE TO WORKPIECE HAVING OBLIQUE SURFACE AND EDGE BANDING MACHINE USING THE GLUE APPLYING MECHANISM

(71) Applicant: OAV EQUIPMENT AND TOOLS, INC., Taichung (TW)

(72) Inventor: Long-Chang Jan, Taichung (TW)

(73) Assignee: OAV EQUIPMENT AND TOOLS, INC., Taichung (TW)

( * ) Notice: Subject to any disclaimer, the term of this patent is extended or adjusted under 35 U.S.C. 154(b) by 0 days.

This patent is subject to a terminal disclaimer.

(21) Appl. No.: 17/330,577

(22) Filed: May 26, 2021

(65) Prior Publication Data

US 2022/0379336 A1 Dec. 1, 2022

(51) Int. Cl.
*B05C 5/02* (2006.01)

(52) U.S. Cl.
CPC ..... *B05C 5/0204* (2013.01)

(58) Field of Classification Search
None
See application file for complete search history.

(56) References Cited

U.S. PATENT DOCUMENTS 3,239,402 A * 3/1966 Ecklund ..... B21D 51/2676 156/200
3,405,022 A * 10/1968 Donlin ..... B27D 5/003 156/304.6
3,590,754 A * 7/1971 Jakobsen ..... A47B 13/083 52/800.11
3,649,417 A * 3/1972 Izen et al. ..... B27D 5/003 156/212
3,676,272 A * 7/1972 White et al. ..... B27D 5/003 156/574
3,753,832 A * 8/1973 Veneziale, Jr. ..... B05B 12/24 156/499
4,029,935 A * 6/1977 Archer ..... B29C 66/8181 156/577
4,222,812 A * 9/1980 Duewel ..... B29C 63/003 156/499
4,394,408 A * 7/1983 Walter ..... B05C 3/20 427/232

(Continued)

*Primary Examiner* — Jethro M. Pence
(74) *Attorney, Agent, or Firm* — Muncy, Geissler, Olds & Lowe, P.C.

(57) ABSTRACT

A glue applying mechanism of an edge banding machine for applying glue to an oblique surface and a vertical surface of a workpiece includes a base including a glue tub, and a glue applying unit rotatably disposed on the glue tub and including a glue shaft and an obliquely glue applying member connected to the top end of the glue shaft and having a glue applying surface which is a tapered surface with a wide top and a narrow bottom. At least the partial top of the glue shaft and the glue applying surface are exposed outside the glue tub. The glue applying unit is rotatable to extract the glue in the glue tub to the outer surface of the glue shaft and the glue applying surface, enabling the glue to be applied to the oblique and vertical surfaces of the workpiece simultaneously by only one glue applying mechanism.

10 Claims, 8 Drawing Sheets

(56) References Cited

U.S. PATENT DOCUMENTS 4,409,060 A * 10/1983 Janssens ..... B29C 63/0026 156/499
5,112,439 A * 5/1992 Reisman ..... H01L 21/30655 257/E21.171
5,370,319 A * 12/1994 Schlegel ..... B05C 5/001 239/582.1
5,660,678 A * 8/1997 Parker, Jr. ..... B65H 35/02 156/577
5,996,659 A * 12/1999 Burgess ..... B27G 13/14 144/92
6,063,475 A * 5/2000 Ciancio ..... B32B 27/06 428/212
6,263,938 B1 * 7/2001 Maioli ..... B27D 5/003 156/468
6,336,702 B1 * 1/2002 Zapata ..... B41J 11/42 347/41
6,447,566 B1 * 9/2002 Rivera ..... B01D 46/121 55/497
6,467,522 B1 * 10/2002 Durney ..... B27D 5/003 156/355
7,189,442 B1 * 3/2007 Jesse ..... B32B 21/08 52/390
9,662,831 B1 * 5/2017 Lin ..... B29C 63/0026
10,124,536 B1 * 11/2018 Jan ..... B29C 65/78
10,479,027 B1 * 11/2019 Chang ..... B26D 1/24
10,954,412 B1 * 3/2021 Picker ..... C09J 7/243
2002/0152957 A1 * 10/2002 Pedigrew ..... B05C 5/0204 118/410
2003/0049371 A1 * 3/2003 Fort ..... B65B 51/023 427/207.1
2003/0054110 A1 * 3/2003 Yamaguchi ..... B05C 5/005 427/420
2003/0070615 A1 * 4/2003 Cottier ..... E04F 15/12 118/300
2003/0077390 A1 * 4/2003 Potyrailo ..... B82Y 30/00 506/40
2003/0170379 A1 * 9/2003 Tsujii ..... C03C 17/001 427/8
2003/0180453 A1 * 9/2003 Burke ..... B05C 11/1015 239/104
2004/0065066 A1 * 4/2004 Mertz ..... B01D 46/521 55/497
2007/0006970 A1 * 1/2007 Such ..... B27D 5/006 156/324
2007/0029031 A1 * 2/2007 Sgroi ..... B65H 81/08 156/425
2009/0280321 A1 * 11/2009 Empting, Jr. ..... C09J 7/24 428/339
2010/0004399 A1 * 1/2010 Empting, Jr. ..... C08L 23/0853 525/221
2011/0226410 A1 * 9/2011 Empting, Jr. ..... C09J 7/29 156/244.11
2012/0019490 A1 * 1/2012 Huang ..... G09G 3/32 345/83
2012/0058279 A1 * 3/2012 Schmid ..... B27D 5/003 427/337
2012/0186515 A1 * 7/2012 Lin ..... B27D 5/003 118/244
2012/0240846 A1 * 9/2012 Lin ..... B05C 11/041 118/244
2014/0205779 A1 * 7/2014 Lin ..... A47B 96/201 428/34.1
2015/0064414 A1 * 3/2015 Empting, Jr. ..... B32B 3/08 156/244.11
2016/0107281 A1 * 4/2016 Rathgeber ..... B27M 1/08 198/345.1
2018/0022489 A1 * 1/2018 Tanner ..... B65B 13/187 53/399
2019/0017702 A1 * 1/2019 Van Oeveren ..... B29C 65/106
2020/0384495 A1 * 12/2020 Chang ..... B05C 1/006

* cited by examiner

GLUE APPLYING MECHANISM OF EDGE BANDING MACHINE FOR APPLYING GLUE TO WORKPIECE HAVING OBLIQUE SURFACE AND EDGE BANDING MACHINE USING THE GLUE APPLYING MECHANISM

BACKGROUND OF THE INVENTION

1. Field of the Invention

The present invention relates to a glue applying mechanism of an edge banding machine and more particularly, to a glue applying mechanism of an edge banding machine for applying glue to a workpiece having an oblique surface, and the edge banding machine using the aforementioned glue applying mechanism.

2. Description of the Related Art

The traditional edge banding machine is adapted to apply glue to a workpiece to be processed, and attach an edge band to the workpiece applied with the glue. The surface of the workpiece can be protected by the edge band and attain an embellished effect.

However, the edge banding process sometimes has to be performed to the workpiece of special specifications. For example, FIG. 1 shows a workpiece W to be processed, which is a part of a drawer or cabinet. The side surfaces of the workpiece W include a pair of horizontal surfaces F3 and F4, a pair of vertical surfaces F2 and F5, and an oblique surface F1, wherein two opposite ends of the oblique surface F1 are connected with the horizontal surface F3 and the vertical surface F2 respectively. In the condition without a handle, the design with the oblique surface F1 is convenient for the user to pull out the whole drawer by only pulling the oblique surface by a hand, that makes the entire drawer relatively simpler and more concise visually and increases the quality of the product.

For performing the edge banding process to the aforementioned workpiece W, especially gluing edge bands to the oblique surface F1 and the adjacent vertical surface F2 of the aforementioned workpiece W, the traditional edge banding machine should use two sets of glue applying mechanism to apply glue to the aforementioned oblique surface F1 and vertical surface F2 respectively. In this way, however, it has to spare the limited inner space of the edge banding machine for the installation of another set of glue applying mechanism. If it uses a same drive motor to drive two sets of glue applying mechanism at the same time for saving space and cost, the drive motor should be relatively higher in rated maximum power. That will raise the entire manufacturing cost of the edge banding machine, so the traditional glue applying mechanism of the edge banding machine needs improvement.

SUMMARY OF THE INVENTION

It is one of the objectives of the present invention to make an improvement for the deficiencies of the conventional glue applying mechanism of the edge banding machine, so as to provide a new glue applying mechanism of the edge banding machine, which enables the glue applying process to be performed to the oblique surface and vertical surface of the workpiece at the same time in the condition of using only one glue applying mechanism, so as to save the limited inner space of the edge banding machine and the entire manufacturing cost.

Therefore, the present invention provides a glue applying mechanism of an edge banding machine, which includes a base and a glue applying unit. The base includes a glue tub. The glue tub is adapted for accommodating glue. The glue applying unit is rotatably disposed on the glue tub of the base and includes a glue shaft and an obliquely glue applying member. The top end of the glue shaft is coaxially connected with the obliquely glue applying member. The aforementioned obliquely glue applying member has a glue applying surface which is a tapered surface with a wide top and a narrow bottom. At least a part of the top of the glue shaft and the glue applying surface of the obliquely glue applying member are exposed outside the glue tub. The glue applying unit is able to be driven to rotate to extract the glue in the glue tub to the outer surface of the glue shaft and the glue applying surface of the obliquely glue applying member, so that the glue applying unit of the glue applying mechanism can apply the glue to the oblique surface and the vertical surface of the workpiece by the outer surface of the glue shaft and the glue applying surface of the obliquely glue applying member at the same time, thereby enabling the glue applying process to be performed to the oblique surface and vertical surface of the workpiece at the same time in the condition of using only one glue applying mechanism.

In an aspect, for performing the glue applying process to workpieces of different heights, in structure, a threaded rod is coaxially fixed on the top surface of the glue shaft. The obliquely glue applying member is provided with a large hole portion and a small hole portion. The large hole portion is located below the small hole portion and communicates with the small hole portion. A shoulder surface is defined between the large hole portion and the small hole portion. The large hole portion is sleeved onto the top end of the glue shaft. The small hole portion is sleeved onto the threaded rod. The glue applying unit has a nut and a first elastic member. The nut is screwed onto the threaded rod and abutted against the top surface of the small hole portion. The first elastic member is abutted between the shoulder surface and the top surface of the top end of the glue shaft. The glue applying surface is located on the outer surface of the large hole portion. Therefore, tightening or loosening the nut to compress or release the elastic restoring force accumulated by the first elastic member can make the obliquely glue applying member approach or leave the glue shaft to be adapted for the workpieces of different heights.

In another aspect, for making the whole glue applying unit relatively more stable, the base structurally includes a fixed seat, and the glue applying unit includes a bearing. The fixed seat is connected above the glue tub and has a through hole. The small hole portion of the obliquely glue applying member is located in the aforementioned through hole. The bearing is sleeved onto the outer wall of the small hole portion. The inner and outer end surfaces of the bearing are abutted against the outer wall of the small hole portion and the inner wall of the through hole respectively.

In another aspect, for extracting the glue to the glue applying surface of the obliquely glue applying member relatively more effectively, the glue applying surface of the obliquely glue applying member is provided with a concave and convex structure. The concave and convex structure may be a cone-shaped spiral groove or embossed structure, but the present invention is unlimited thereto. In this way, the applied glue will have undulate surface, which is relatively more effective in filling the gap between the edge band and the workpiece in the follow-up step of attaching the edge band, so that the products will be manufactured with relatively higher quality.

BRIEF DESCRIPTION OF THE DRAWINGS

The present invention will become more fully understood from the detailed description given herein below and the accompanying drawings which are given by way of illustration only, and thus are not limitative of the present invention, and wherein.

DETAILED DESCRIPTION OF THE INVENTION

The technique and features of the present invention will be detailedly specified in the instanced embodiment given herein below and the accompanying drawings. The directional terms mentioned in this specification, such as 'above', 'below', 'inner', 'outer', 'top' and 'bottom', are just for illustrative description on the basis of normal usage direction, not intended to limit the claimed scope.

For the detailed description of the technical features of the present invention, an illustrative embodiment and the accompanying drawings are given herein below.

Figure 1:
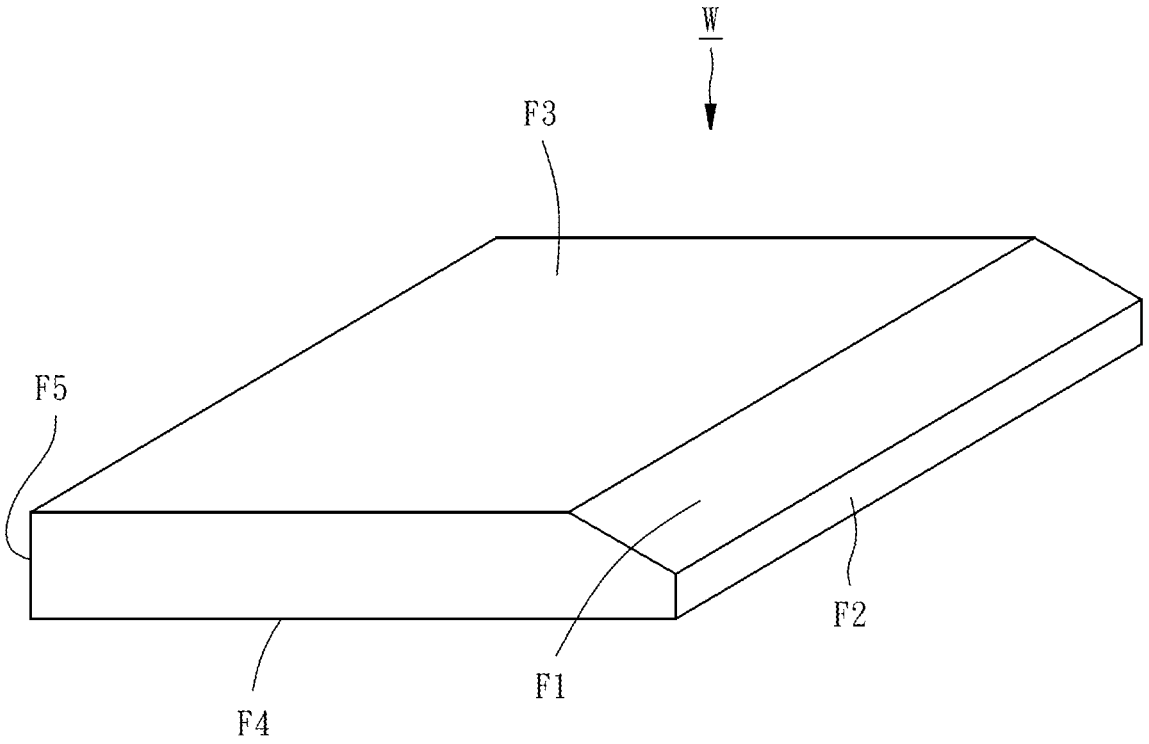
FIG. 1 is a perspective view of a workpiece to be processed.
Figure 2:
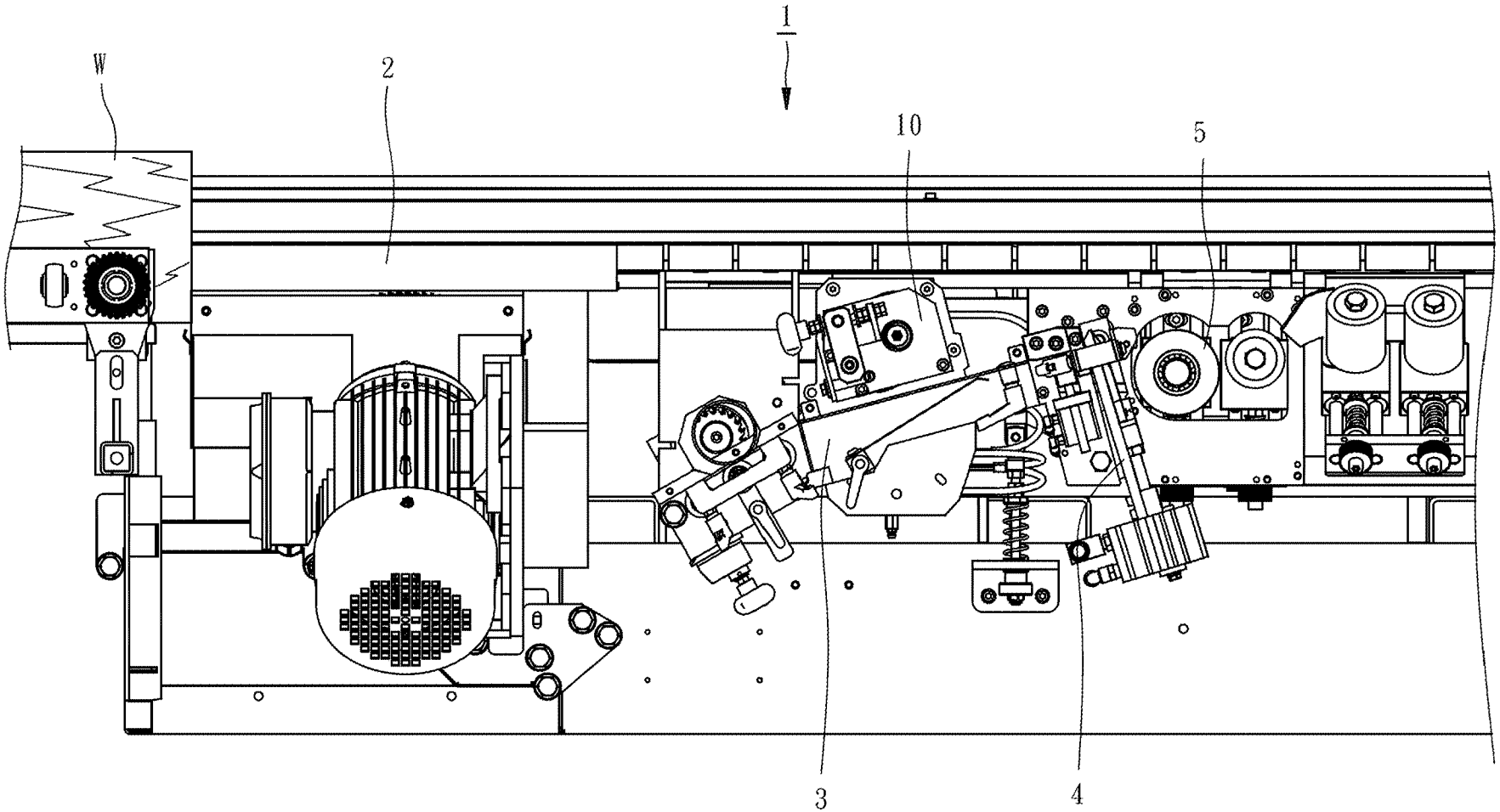
FIG. 2 is a partial top view of an edge banding machine of an embodiment.
Figure 3:
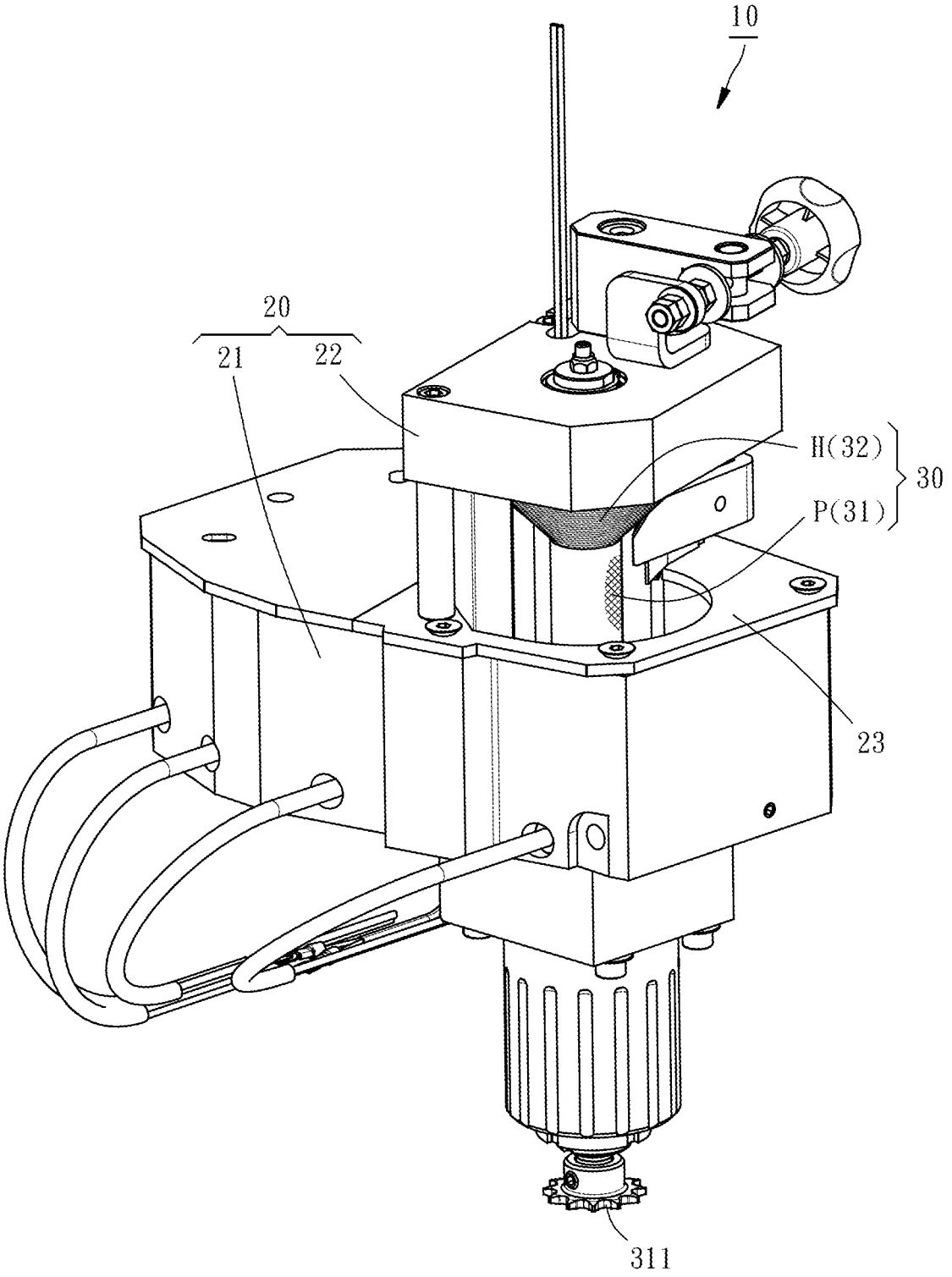
FIG. 3 is a perspective view of a glue applying mechanism of the edge banding machine of the embodiment.

As shown in FIG. 1 and FIG. 2, this embodiment provides an edge banding machine 1. The edge banding machine 1 structurally includes a pre-milling mechanism 2, a glue applying mechanism 10, an edge band conveying mechanism 3, a set of knives 4, and a horizontal pressing wheel set 5. The pre-milling mechanism 2 is adapted for trimming the surface of the workpiece W when the workpiece W is not applied with glue yet. The glue applying mechanism 10 is adapted for applying glue to an oblique surface F1 and a vertical surface F2 of the workpiece W after it is trimmed, as shown in FIG. 1. The edge band conveying mechanism 3 is adapted for conveying an edge band (not shown). The knife 4 is adapted for cutting off the edge band to a predetermined length, enabling the cut-off edge band to be tightly boned to the oblique surface F1 and vertical surface F2 of the workpiece W when the glue-applied workpiece W passes through the horizontal pressing wheel set 5. In this embodiment, the workpiece W is a part of a drawer, but this embodiment is unlimited thereto.

Figure 4:
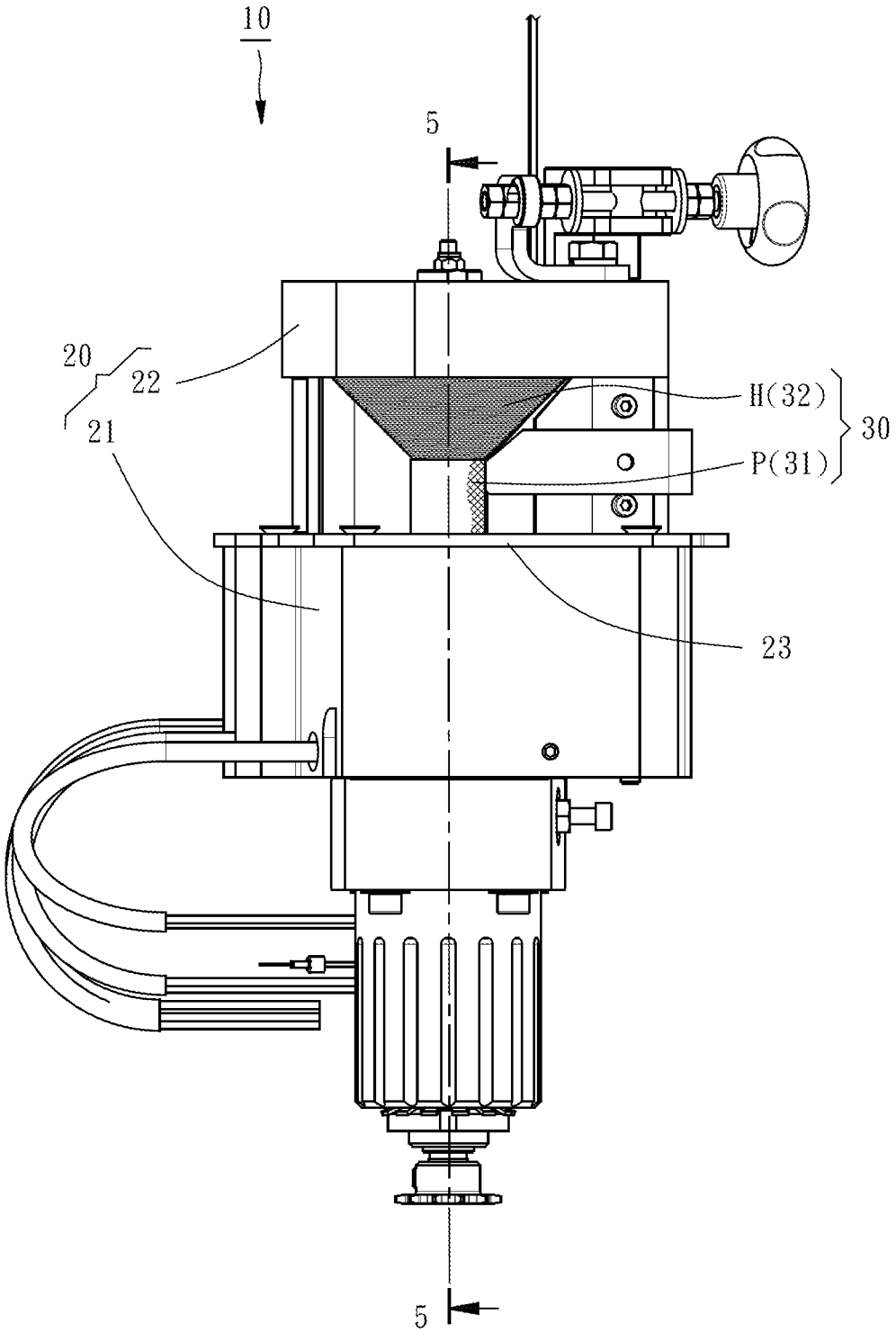
FIG. 4 is a side view of FIG. 3.
Figure 5:
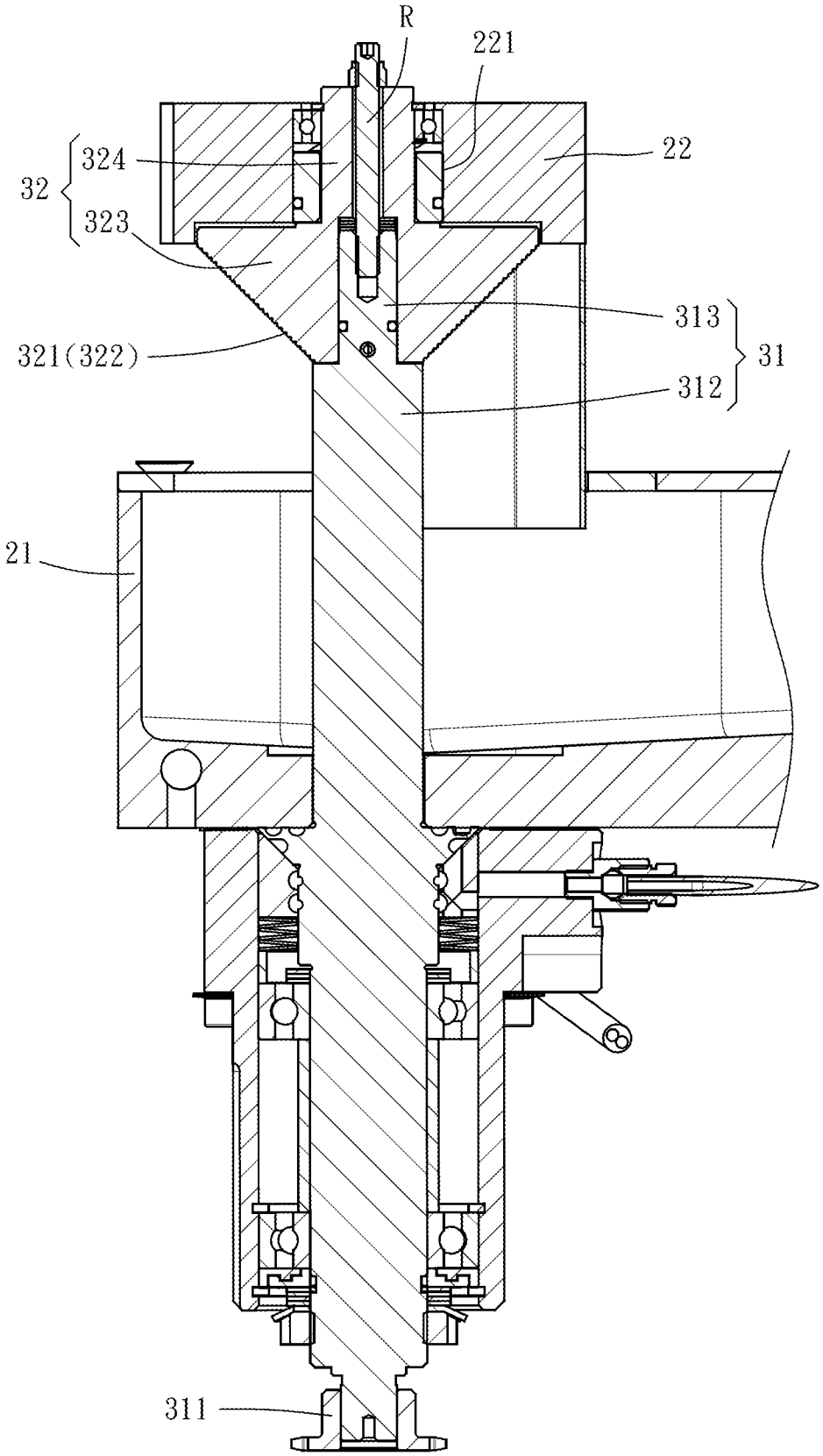
FIG. 5 is a sectional view taken along the line 5-5 in FIG. 4.

As shown in FIG. 3 to FIG. 6, the glue applying mechanism 10 structurally includes a base 20 and a glue applying unit 30. The base 20 structurally includes a glue tub 21 and a fixed seat 22. The glue tub 21 is adapted for accommodating glue. The fixed seat 22 is located above the glue tub 21 and fixed above the glue tub 21 through a covering plate 23. The fixed seat 22 has a through hole 221, as shown in FIG. 5.

Figure 6:
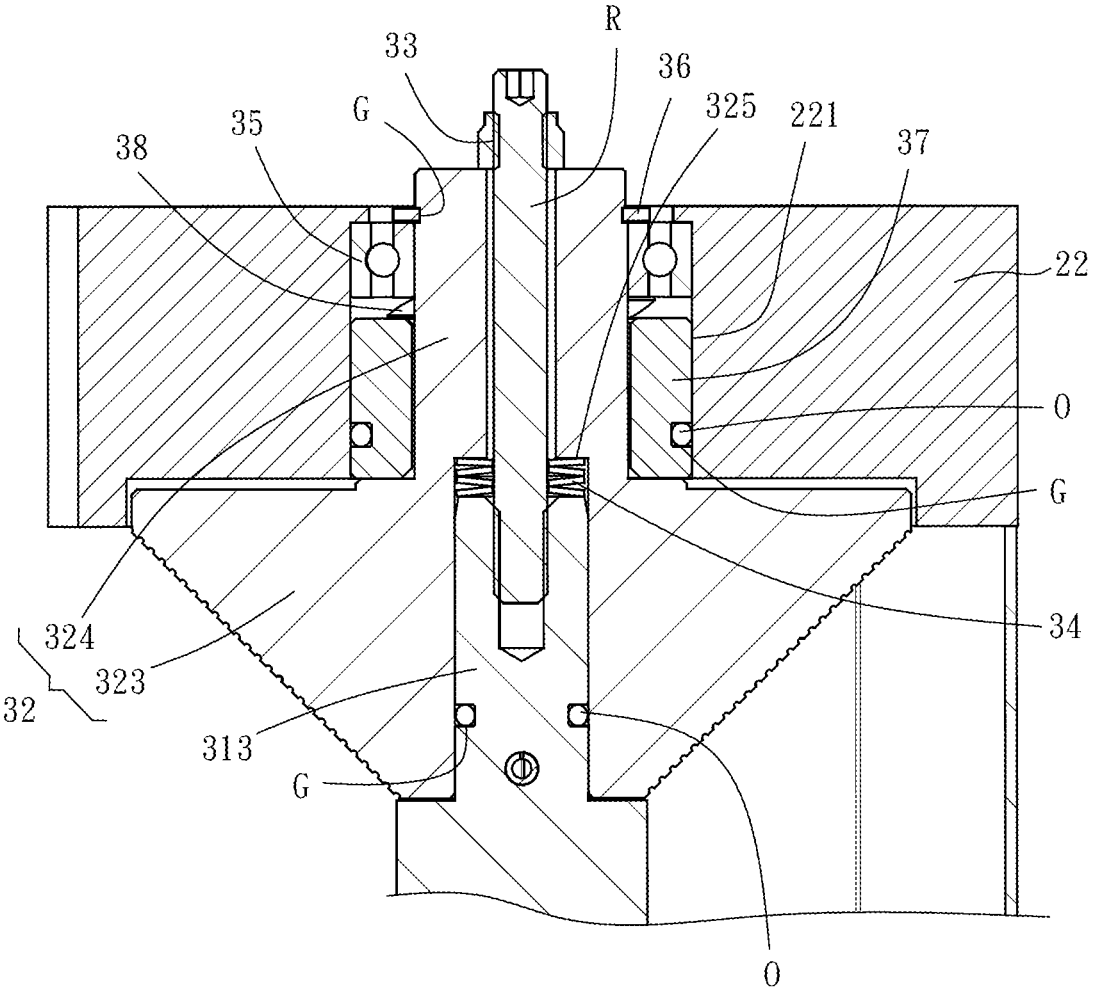
FIG. 6 is a partially enlarged view of FIG. 5.

The glue applying unit 30 is rotatably disposed on the glue tub 21 of the base 20 and structurally includes a glue shaft 31 and an obliquely glue applying member 32. The glue shaft 31 is provided on the outer surface thereof with an embossed structure P. The bottom end of the glue shaft 31 protrudes out of the glue tub 21, and the bottom end of the glue shaft 31 is connected with a chain wheel 311, enabling the edge banding machine 1 that the glue shaft 31 is driven to rotate through a motor and a chain (not shown), the technique of that can be referred to Taiwan Patent No. I691365. As shown in FIG. 5 and FIG. 6, the glue shaft 31 structurally includes a large radius portion 312 and a small radius portion 313. The small radius portion 313 is located at the top end of the large radius portion 312 and connected with the large radius portion 312 integrally and coaxially. The outer wall of the small radius portion 313 is provided with an embedding groove G for an O-ring O to be disposed therein, thereby avoiding the permeating of the glue. A threaded rod R is coaxially fixed on the top surface of the small radius portion 313. The threaded rod R is inserted into the through hole 221 and protrudes out of the through hole 221.

Figure 7:
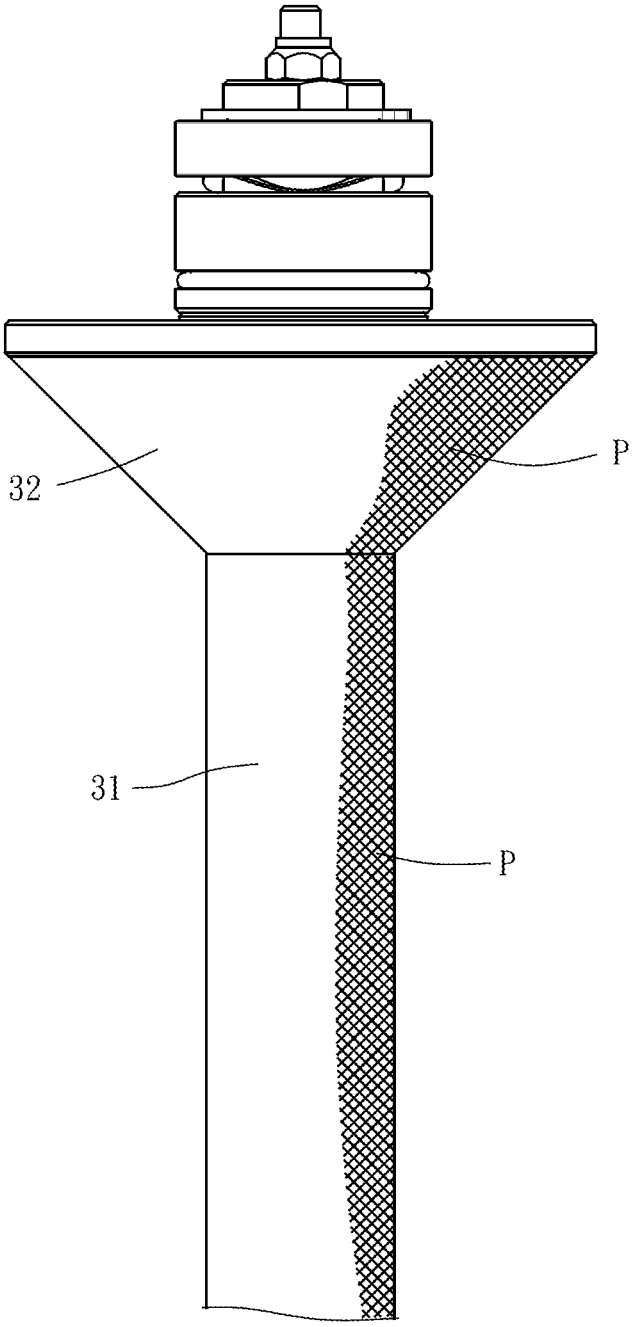
FIG. 7 is a partial side view of a glue applying unit, for illustrating the situation that the glue applying surface of the obliquely glue applying member has an embossed structure.

The obliquely glue applying member 32 is coaxially connected to the top of the glue shaft 31. The obliquely glue applying member 32 has a glue applying surface 321. The glue applying surface 321 is a tapered surface with a wide top and a narrow bottom. The glue applying surface 321 in this embodiment is an inverted conical surface. The glue applying surface 321 is provided thereon with a concave and convex structure 322. In this embodiment, the concave and convex structure 322 is a cone-shaped spiral groove H, as shown in FIG. 4. The concave and convex structure 322 may be an embossed structure P, as shown in FIG. 7. Specifically speaking, the obliquely glue applying member 32 structurally includes a large hole portion 323 and a small hole portion 324. The large hole portion 323 is located below the small hole portion 324, and the large hole portion 323 communicates with the small hole portion 324. The glue applying surface 321 is located on the outer surface of the large hole portion 323. A shoulder surface 325 is defined between the large hole portion 323 and the small hole portion 324. The large hole portion 323 is sleeved onto the small radius portion 313 of the glue shaft 31. The small hole portion 324 is sleeved onto the threaded rod R, and the small hole portion 324 is located in the through hole 221 of the fixed seat 22. The glue applying unit 30 includes a nut 33, a first elastic member 34, a bearing 35, a snap ring 36, a bushing 37, and a second elastic member 38. The nut 33 is screwed onto the threaded rod R and abutted against the top surface of the small hole portion 324. The first elastic member 34 in this embodiment includes a plurality of disc springs piled in a front connected with back manner. The first elastic member 34 is abutted between the aforementioned shoulder surface 325 and the top surface of the small radius portion 313. The bearing 35 is sleeved onto the small hole portion 324, and the inner and outer end surfaces of the bearing 35 are abutted against the outer wall of the small hole portion 324 and the inner wall of the through hole 221 respectively. The snap ring 36 is disposed in an embedding groove G of the small hole portion 324 for preventing the bearing 35 form upward coming off. The bushing 37 is sleeved onto the small hole portion 324 and located below the bearing 35. The bushing 37 is also provided with an embedding groove G for an O-ring O to be disposed therein. The second elastic member 38 in this embodiment is a wave spring, which is disposed between the bearing 35 and the bushing 37.

At least a part of the top of the glue shaft 31, especially a part of the large radius portion 312, and the glue applying surface 321 of the obliquely glue applying member 32 are protruded and exposed outside the glue tub 21. Therefore, when the glue applying unit 30 is driven by the motor to rotate, the glue applying unit 30 can extract the molten glue in the glue tub 21 to the outer surface of the large radius portion 312 of the glue shaft 31 and the glue applying surface 321 of the obliquely glue applying member 32, so that the glue applying unit 30 can apply the glue to the oblique surface F1 and vertical surface F2 of the workpiece W at the same time by the outer surface of the glue shaft 31 and the glue applying surface 321 of the obliquely glue applying member 32.

By the above-described configuration of the edge banding machine 1, when the workpiece W is conveyed to the glue applying mechanism 10, the glue applying unit 30 of the glue applying mechanism 10 can apply the glue to the oblique surface F1 and vertical surface F2 of the workpiece W at the same time by the glue shaft 31 and the obliquely glue applying member 32, so as to attach edge bands to the oblique surface F1 and vertical surface F2 of the workpiece W, attaining protecting and embellishing effects. Therefore, it can be seen in this embodiment that the glue applying process can be performed to different outer surfaces of the workpiece W at the same time in the condition of using only one glue applying mechanism 10, that can save the limited inner space of the edge banding machine 1 and the entire manufacturing cost.

Figure 8A:
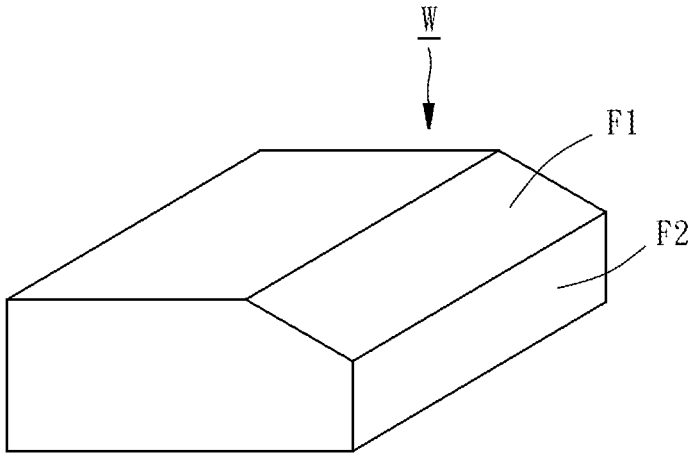
FIGS. 8*a*-8*c* are perspective views of workpieces to be processed.

Besides, it is adapted for performing the glue applying process to the workpieces W of different sizes. For example, the workpiece W as shown in FIG. 8*a* also has the oblique surface F1 and vertical surface F2, but the workpiece W is relatively higher in overall height, which means the vertical surface F2 is relatively higher. In such condition, the operator can loosen the nut 33 to release the elastic restoring force accumulated by the first elastic member 34 to make the obliquely glue applying member 32 displace upwardly relative to the glue shaft 31, so that the glue applying unit 30 can apply the glue to the oblique surface F1 and vertical surface F2 of the relatively higher workpiece W at the same time. Conversely, for the workpiece W relatively lower in height, the operator can adjust the obliquely glue applying member 32 by tightening the nut 33.

Figure 8B:
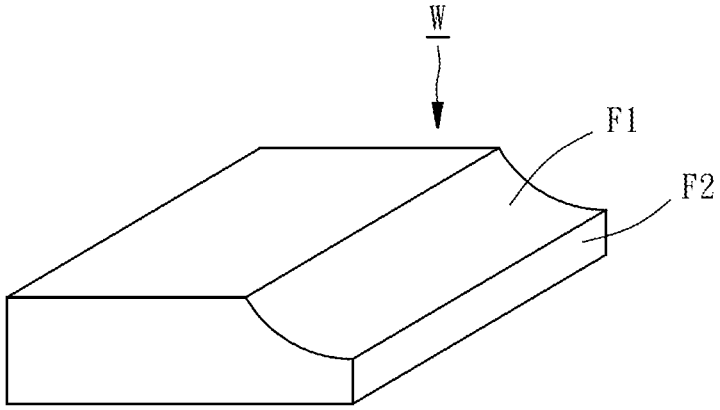
Figure 8C:
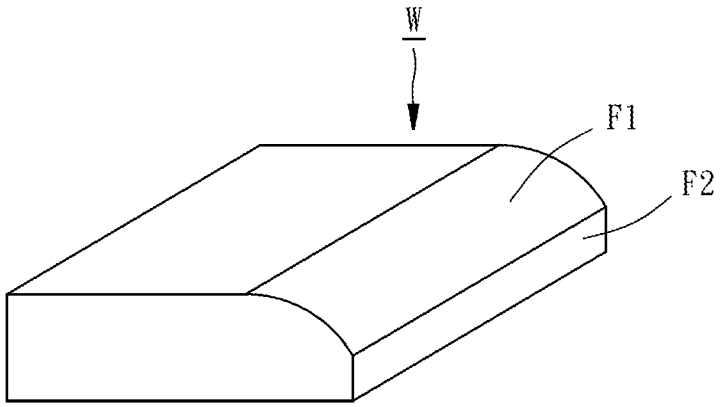

In addition, because of different requirements, the oblique surface F1 of the workpiece W may be a concave surface as shown in FIG. 8*b* or a convex surface as shown in FIG. 8*c*. For such conditions, the operator can correspondingly replace the obliquely glue applying member 32 of the glue applying unit 30 to adapt the glue applying mechanism 10 for the workpieces W of different structures and sizes by using the obliquely glue applying member 32 conformable to the curved surface as described above, which means at this time the glue applying surface 321 has the corresponding convex or concave shape.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A glue applying mechanism of an edge banding machine for applying glue to a workpiece having an oblique surface, the glue applying mechanism comprising:

a base comprising a glue tub which is adapted for accommodating glue; and a glue applying unit rotatably disposed on the glue tub of the base and comprising a glue shaft and an obliquely glue applying member, the obliquely glue applying member being coaxially connected to a top of the glue shaft, the obliquely glue applying member having a glue applying surface which is a tapered surface with a wide top and a narrow bottom, at least a part of the top of the glue shaft and the glue applying surface of the obliquely glue applying member being exposed outside the glue tub, the glue applying unit being able to be driven to rotate to extract the glue in the glue tub to an outer surface of the glue shaft and the glue applying surface of the obliquely glue applying member.

2. The glue applying mechanism as claimed in claim 1, wherein a threaded rod is coaxially fixed on a top surface of the glue shaft; the obliquely glue applying member comprises a larger hole portion and a smaller hole portion; the larger hole portion is located below the smaller hole portion and communicates with the smaller hole portion; a shoulder surface is defined between the larger hole portion and the smaller hole portion; the larger hole portion is sleeved onto a top end of the glue shaft; the smaller hole portion is sleeved onto the threaded rod; the glue applying unit has a nut and a first elastic member; the nut is screwed onto the threaded rod and abutted against a top surface of the smaller hole portion; the first elastic member is abutted between the shoulder surface and a top surface of the top end of the glue shaft; the glue applying surface is located on an outer surface of the larger hole portion.

3. The glue applying mechanism as claimed in claim 2, wherein the glue shaft comprises a larger radius portion and a smaller radius portion; the smaller radius portion is coaxially connected with a top end of the larger radius portion; the larger hole portion is sleeved onto the smaller radius portion.

4. The glue applying mechanism as claimed in claim 2, wherein the base comprises a fixed seat; the glue applying unit comprises a bearing; the fixed seat is fixed above the glue tub and has a through hole; the smaller hole portion of the obliquely glue applying member is located in the through hole; the bearing is sleeved onto the smaller hole portion; inner and outer end surfaces of the bearing are abutted against an outer wall of the smaller hole portion and an inner wall of the through hole respectively.

5. The glue applying mechanism as claimed in claim 4, wherein the glue applying unit has a bushing, a snap ring, and a second elastic member; the bushing is sleeved onto the outer wall of the smaller hole portion; the smaller hole portion is provided with an embedding groove; the snap ring is disposed in the embedding groove and abutted against a top surface of the bearing; the second elastic member is disposed between the bearing and the bushing.

6. The glue applying mechanism as claimed in claim 1, wherein the glue applying surface of the obliquely glue applying member is provided with a concave and convex structure.

7. The glue applying mechanism as claimed in claim 6, wherein the concave and convex structure is a cone-shaped spiral groove or an embossed structure.

8. An edge banding machine for applying glue to an oblique surface and a vertical surface of a workpiece and attaching an edge band to the oblique surface and the vertical surface, the edge banding machine comprising a glue applying mechanism, the glue applying mechanism comprising a base and a glue applying unit, the base comprising a glue tub which is adapted for accommodating glue, the glue applying unit being rotatably disposed on the glue tub of the base and comprising a glue shaft and an obliquely glue applying member, a bottom end of the glue shaft protruding out of the glue tub, the obliquely glue applying member being coaxially connected to a top of the glue shaft, the obliquely glue applying member having a glue applying surface which is a tapered surface with a wide top and a narrow bottom, at least a part of the top of the glue shaft and the glue applying surface of the obliquely glue applying member being exposed outside the glue tub, the glue applying unit being able to be driven to rotate to extract the glue in the glue tub to an outer surface of the glue shaft and the glue applying surface of the obliquely glue applying member to make the glue applying unit apply the glue to the oblique surface and the vertical surface of the workpiece by the outer surface of the glue shaft and the glue applying surface of the obliquely glue applying member at a same time.

9. The edge banding machine as claimed in claim 8, wherein a threaded rod is coaxially fixed on a top surface of the glue shaft; the obliquely glue applying member is provided on a bottom surface and a top surface thereof with a larger hole portion and a smaller hole portion respectively; the larger hole portion communicates with the smaller hole portion; a shoulder surface is located between the larger hole portion and the smaller hole portion; the larger hole portion is sleeved onto a top end of the glue shaft; the smaller hole portion is sleeved onto the threaded rod; the glue applying unit has a nut and a first elastic member; the nut is screwed onto the threaded rod and abutted against a top surface of the smaller hole portion; the first elastic member is abutted between the shoulder surface and a top surface of the top end of the glue shaft; the glue applying surface is located on an outer surface of the larger hole portion.

10. The edge banding machine as claimed in claim 8, wherein the glue applying surface of the obliquely glue applying member is provided with a concave and convex structure.

* * * * *